United States Patent [19]

Epsztein

[11] Patent Number: 4,486,687

[45] Date of Patent: Dec. 4, 1984

[54] ELECTRON GUN FOR CONVERGENT BEAM, AND A DEVICE, PARTICULARLY A VIDICON TUBE, EQUIPPED WITH SUCH A GUN

[75] Inventor: Bernard Epsztein, Paris, France

[73] Assignee: Thomson-CSF, Paris, France

[21] Appl. No.: 261,466

[22] Filed: May 7, 1981

[30] Foreign Application Priority Data

May 15, 1980 [FR] France ..... 80 10846

[51] Int. Cl.[3] ..... H01J 29/46; H01J 29/56

[52] U.S. Cl. ..... 315/14; 313/449; 313/424

[58] Field of Search ..... 315/14, 15, 382, 31 R; 313/449, 452, 424

[56] References Cited

U.S. PATENT DOCUMENTS

| | | | |
|---|---|---|---|
| 3,141,993 | 7/1964 | Hahn . | |
| 3,904,913 | 9/1975 | Spencer | 313/449 |
| 3,924,153 | 12/1975 | McIntyre . | |
| 4,009,410 | 2/1977 | Pommier et al. | 313/411 |
| 4,044,282 | 8/1977 | Balandin et al. | 313/449 |
| 4,268,777 | 5/1981 | Van Roosmalen | 315/31 R |

FOREIGN PATENT DOCUMENTS

| | | |
|---|---|---|
| C912725 | 4/1954 | Fed. Rep. of Germany . |
| 2738928 | 3/1978 | Fed. Rep. of Germany . |
| 2201536 | 4/1974 | France . |
| Ad.469418 | 7/1937 | United Kingdom . |

OTHER PUBLICATIONS

Positive Ion Trapping in Electron Beams, E. L. Ginzton and B. H. Wadia, Proceedings of the IRE.

*Primary Examiner*—Theodore M. Blum
*Attorney, Agent, or Firm*—Roland Plottel

[57] ABSTRACT

For reducing as much as possible the dimension of converging electron beams, at their point of minimum section, the invention provides in this zone an ionic charge counterbalancing the space charge of the beam, by means of an equipotential electrode disposed about this point. Said electrode is the tube in the figure. When further modulation is applied to the beam, the electrode which ensures it is placed after it in the path thereof.

2 Claims, 2 Drawing Figures

ELECTRON GUN FOR CONVERGENT BEAM, AND A DEVICE, PARTICULARLY A VIDICON TUBE, EQUIPPED WITH SUCH A GUN

BACKGROUND OF THE INVENTION

The invention relates to an electron gun.

In numerous electronic devices and tubes, the electron beam produced by the gun is subjected, in the first part of its travel, to the action of means which impart thereto a convergence towards a point situated at a greater or lesser distance in front of the cathode. Beyond, different treatments are applied thereto, related to the use for which the unit is intended in which is incorporated the gun by which it is produced. These treatments are outside the scope of the invention.

Ideally, the point of convergence, where the electron paths cross, is a point in the geometrical sense of the word; in fact, considering the mutual repulsion of the charges which form it, the beam still presents at the point of convergence, and whatever the means used, a certain section whose area depends on numerous parameters and characteristics of the gun.

The electrons, after passing through this zone of minimum section, known also under the name of "cross-over", will form an image of this section on the part of the tube intended to receive their impact, screen, target . . .

The diameter of this impact depends on that of the cross-over in question; it is then desirable to reduce it to the maximum so as to improve the resolution of the surface subjected to the impact and, for this, to reduce the dimension of the cross-over.

This approach is however limited by the above-mentioned repulsion, i.e. the space charge within the beam.

SUMMARY OF THE INVENTION

The object of the present invention is an electron gun for a convergent beam having means adapted to lower this limit.

These means ensure the creation, in the region of the crossing point, of a static distribution of positive ions, whose total charge is substantially equal in absolute value to that of the electrons of the beam in this region.

The invention relates to an electron gun for a convergent beam, comprising a cathode and means cooperating with this cathode to produce, within a vacuum space, an electron beam directed along an axis, and to ensure the convergence of this latter in the first part of its travel towards a point of minimum section, characterized in that it comprises, disposed about this axis, in the vicinity of this point, a hollow electrode raised to a potential constant in time and positive with respect to the cathode.

DESCRIPTION OF THE DRAWINGS

The invention will be better understood by referring to the following description and to the accompanying figures which represent.

DESCRIPTION OF THE PREFERRED EMBODIMENTS

Figure 1:
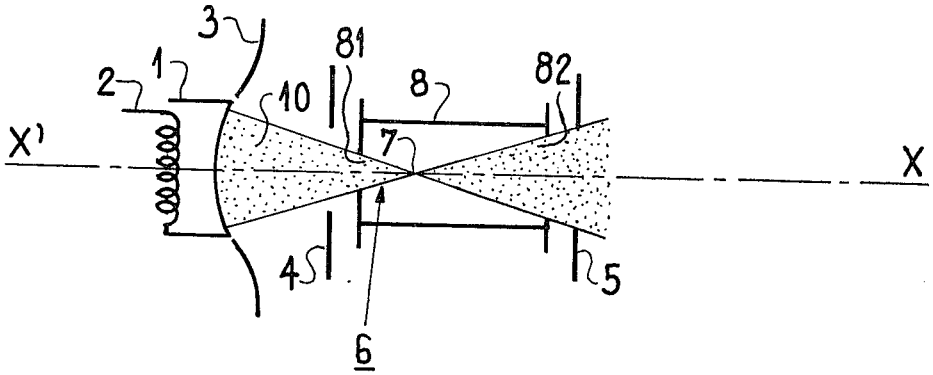
FIGS. 1 and 2: two variations of the electron gun of the invention.

The gun comprises a cathode 1, heated by a filament 2 in the example; a Wehnelt electrode 3, brought to a negative or zero potential with respect to the cathode taken as reference, controls the intensity of beam 6, shown in the figure by the surface covered with dots, emitted by the cathode under operating conditions, when a positive voltage is applied to the acceleration electrode 8. These conditions are such that the beam converges in its part 10 towards the point referenced 7 in the figure. In the figure, 20 designates the vacuum enclosure in which the gun is housed.

In the gun of the invention, electrode 8 is provided in the form of a hollow electrode surrounding this point of convergence; this electrode is wholly at the same voltage, constant in time.

In the example, this equipotential part is in the form of a tube, the orifices of which bear the references 81 and 82, disposed along the axis X'X along which the beam is propagated in operation; beyond electrode 8, the shape of the beam has not been specified since it depends on the treatments to which it is subjected, with respect to the use which is made thereof in the tube with which the gun is incorporated.

The conditions prevailing in such a gun are outlined below.

In the absence of a beam, the potential along electrode 8 is uniform; the production of the beam, by enabling of the Wehnelt for example, results in a lowering of this potential in the greatest part of electrode 8, where there appears a potential trough; even under the best vacuum conditions, $10^{-8}$ to $10^{-9}$ torr, in the present state of the technique, the beam causes in its passage the ionization of residual gas molecules present in the vacuum enclosure, i.e. the creation of electron (−), ion (+) pairs.

The created electron, which has low kinetic energy because of its mass, is pushed back by the space charge of the beam and tends to leave this latter; it will be lost on the electrodes at a positive potential such as electrode 8.

The ions, on the other hand, attracted by this same space charge, mix with the electrons within the beam, and fill up the potential trough created by the beam, to the extent that they are unable to escape from electrode 8 through orifices 81 and 82; further reference will be made to this point farther on. The excess ions, created from the moment when this situation is reached, in indifferent equilibrium, finish up on the electrodes. At this moment an overall equilibrium is reached and the potential inside the hollow electrode 8 is then uniform.

The first-named ions attracted by the beam remain therein because of the electron attraction which they undergo. The space charge of the electrons is then counterbalanced and the crossing place 7 is reduced in size until it becomes practically pinpoint.

This situation is that of permanent operating conditions; it is only reached after the time required for generating the ionic charge counterbalancing that of the beam. This time is of the order of 100 microseconds for a residual pressure of $10^{-8}$ torr; it would be no more than 10 nanoseconds for a pressure of $10^{-4}$ torr, a value which is acceptable for numerous applications, but which corresponds to a vacuum generally incompatible with a sufficiently long life expectation of the cathodes, because of the intensity of the ionic bombardment to which they are subjected in this case.

We must then in general reckon with vacuums of the order of $10^{-8}$ torr, and times for bringing up to operating conditions of the order of a hundred or so microseconds as mentioned above. This does not present a drawback in the case of a beam which is subjected to no modulation in time.

It is quite different when such a modulation is practised. In this case, in fact, a reduction in the intensity of the electron beam would cause the ions, which are in excess, to be deposited on the walls of the electrodes under the influence of their own space charge; an appreciable time would be required for reconstituting the equilibrium, which time may be unacceptable for certain applications.

This case is frequently met with; it is in particular the case for all tubes scanning point by point a target with frame return, and for the vidicon tube in particular; the beam is disabled periodically at the time of this return.

Figure 2:
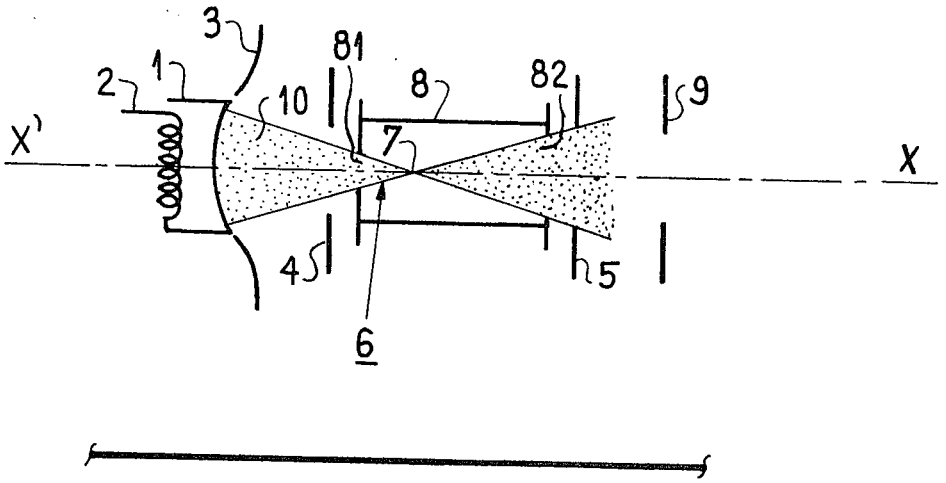

This is why the invention provides, in the case of such a modulation, for the electrode which exercises it to be placed after electrode 8 in the path of the beam. This electrode bears the reference 9 in FIG. 2. In the case of the above-mentioned vidicon, this may be the grid placed in the immediate vicinity of the target. It may also be, in other cases, a diaphragm associated with the deflector unit.

Furthermore, so as to reduce the leakage of ions outside electrode 8, in accordance with a variation of the invention, two additional electrodes, 4 and 5 in the figures, may be advantageously used in all cases; they are disposed on each side of electrode 8 in the immediate vicinity thereof and brought to a positive potential with respect thereto.

Their presence is however not indispensable when the potential increases beyond electrode 8, because of the presence of electronic focusing lenses, for example—this insofar as electrode 5 is concerned—or when the orifices 81 and 82 of electrode 8 are sufficiently small to limit by themselves the leakage of ions towards the outside.

The electron gun of the invention finds an application, besides the above-mentioned vidicon tube, in different devices, such as scanning or transmission electron microscopes, electron probes, etc. The transmission electron microscope is an example of a device free from modulation.

What is claimed is:

1. An electron gun for a convergent beam, comprising a cathode, first means for cooperating with said cathode, said first means having a fixed potential, in order to produce, within a vacuum space, an electron beam directed along an axis and to ensure convergence thereof in the first part of its travel towards a spot of minimum cross-section, second means constituted as a hollow cylinder encircling said spot and closed at both ends except for apertures respectively for entry and exit of said electron beam and having a potential constant in time and positive with respect to said cathode and thereby holding, in the vicinity of said spot, ions created by the impact of the electrons of said electron beam against residual gas molecules present in said vacuum space, and two additional electrodes, provided respectively on each side of said ion holding means and disposed in the immediate vicinity thereof, having positive potentials with respect to said ion holding means and thereby improving the effectiveness of said ion holding means.

2. An electron gun as claimed in claim 1, comprising further means for periodically modulating the intensity of said beam, wherein said modulating means are placed in the path of said electron beam downstream of said ion holding means.

* * * * *